US011261514B2

(12) United States Patent
Banik et al.

(10) Patent No.: US 11,261,514 B2
(45) Date of Patent: Mar. 1, 2022

(54) TEMPORARY CORROSION PROTECTION LAYER

(71) Applicants: ThyssenKrupp Steel Europe AG, Duisburg (DE); ThyssenKrupp AG, Essen (DE)

(72) Inventors: Janko Banik, Altena (DE); Patrick Kuhn, Kamen (DE); Manuela Ruthenberg, Dortmund (DE); Axel Schrooten, Dortmund (DE); Sascha Sikora, Lünen (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 208 days.

(21) Appl. No.: 16/326,780

(22) PCT Filed: Sep. 22, 2017

(86) PCT No.: PCT/EP2017/074042

§ 371 (c)(1),
(2) Date: Feb. 20, 2019

(87) PCT Pub. No.: WO2018/060082

PCT Pub. Date: Apr. 5, 2018

(65) Prior Publication Data

US 2019/0185981 A1 Jun. 20, 2019

(30) Foreign Application Priority Data

Sep. 30, 2016 (DE) ..... 102016218957.3

(51) Int. Cl.

| | |
|---|---|
| ***C23C 2/12*** | (2006.01) |
| ***C23C 2/28*** | (2006.01) |
| ***C23F 11/12*** | (2006.01) |
| ***C23F 11/16*** | (2006.01) |
| ***C23F 11/10*** | (2006.01) |
| ***C21D 1/19*** | (2006.01) |
| ***C21D 6/00*** | (2006.01) |
| ***C21D 1/18*** | (2006.01) |
| ***C21D 1/68*** | (2006.01) |

(52) U.S. Cl.

CPC ..... *C23C 2/12* (2013.01); *C21D 1/18* (2013.01); *C21D 1/19* (2013.01); *C21D 1/68* (2013.01); *C21D 6/005* (2013.01); *C21D 6/008* (2013.01); *C23C 2/28* (2013.01); *C23F 11/10* (2013.01); *C23F 11/122* (2013.01); *C23F 11/128* (2013.01); *C23F 11/16* (2013.01)

(58) Field of Classification Search

CPC . C23C 2/12; C21D 1/68; C23F 11/122; C23F 11/128

See application file for complete search history.

(56) References Cited

U.S. PATENT DOCUMENTS

| | | | | |
|---|---|---|---|---|
| 2,893,880 | A * | 7/1959 | Dieman | C23F 11/10 106/14.29 |
| 3,284,319 | A * | 11/1966 | Hill | C23C 22/33 252/389.23 |
| 3,970,569 | A | 7/1976 | Sturworld et al. | |
| 4,113,635 | A * | 9/1978 | Sakurai | C10M 137/04 508/312 |
| 4,315,957 | A * | 2/1982 | Hereth | C09D 5/008 427/155 |
| 6,398,884 | B1 * | 6/2002 | Kyono | C22C 38/06 148/537 |
| 2011/0056594 | A1 * | 3/2011 | Macherey | C23C 26/00 148/530 |

(Continued)

FOREIGN PATENT DOCUMENTS

| | | |
|---|---|---|
| DE | 102008006771 | 9/2009 |
| GB | 1500807 | 2/1978 |

(Continued)

OTHER PUBLICATIONS

Lunbald R.; et al. "Handbook of biochemistry and Molecular Biology", Taylor and Francis; "Compositions and Properties of Common Oils and Fats"; Data retrieved from Knovel on Mar. 22, 2021; https://app.knovel.com/hotlink/itble/rcid:kpHBMBE003/id:kt00XRCP5T/handbook-biochemistry/compositio-composition (Year: 2010).*

AOCS, "Coconut Oil Boom" May 2016; Retrieved Mar. 22, 2021; https://www.aocs.org/stay-informed/inform-magazine/featured-articles/coconut-oil-boom-may-2016?SSO=True#:~:text=Coconut%20oil%20is%20unique%20in,2 (Year: 2016).*

Office Action for Japanese Serial No. 2019-515886 dated Feb. 27, 2020, 4 pages.

(Continued)

*Primary Examiner* — Alexandra M Moore
*Assistant Examiner* — Austin Pollock
(74) *Attorney, Agent, or Firm* — Rankin, Hill & Clark LLP

(57) ABSTRACT

A method for producing a component made of a steel product coated with an Al—Si protective coating, includes:

providing a substrate consisting of a steel produced coated with an Al—Si protective coating, heating the substrate to a temperature T1 such that the Al—Si protective coating is only partially pre-alloyed with Fe of the steel product, cooling the pre-alloyed substrate to room temperature, applying a corrosion protection oil to the surface of the pre-alloyed substrate, wherein the oil consists of a composition containing fatty acid ester, transporting the pre-alloyed substrate to which the oil has been applied, heating the pre-alloyed substrate to which the oil has been applied to a temperature T2 such that the Al—Si protective coating is fully alloyed with Fe of the steel product and the oil is removed without leaving residue, and shaping the re-heated substrate to form the component.

19 Claims, No Drawings

(56) References Cited

U.S. PATENT DOCUMENTS

| | | | | |
|---|---|---|---|---|
| 2011/0165436 | A1* | 7/2011 | Drillet | C23C 2/26 428/653 |
| 2013/0037178 | A1* | 2/2013 | Coryell | C21D 1/673 148/525 |
| 2016/0312331 | A1* | 10/2016 | Cho | C22C 38/02 |
| 2018/0044754 | A1* | 2/2018 | Azuma | C22C 38/002 |
| 2019/0003029 | A1* | 1/2019 | Oh | B32B 15/20 |

FOREIGN PATENT DOCUMENTS

| | | | |
|---|---|---|---|
| JP | S54-075443 | | 6/1979 |
| JP | H04-000358 | | 1/1992 |
| JP | 08-302490 | | 11/1996 |
| JP | 2009-293078 | | 12/2009 |
| JP | 2009293078 | A * | 12/2009 |
| JP | 2011-514440 | | 5/2011 |
| JP | 2012-511101 | | 5/2012 |
| JP | 2015081368 | A * | 4/2015 |
| JP | 2016-520162 | | 7/2016 |
| JP | 2017-534700 | | 11/2017 |
| WO | 2016158961 | | 6/2016 |
| WO | 2010069588 | | 6/2020 |

OTHER PUBLICATIONS

International Search Report of PCT/EP2017/074042 dated Dec. 20, 2017, 4 pages.
International Preliminary Report on Patentability of PCT/EP2017/074042 dated Apr. 11, 2019, 8 pages.

* cited by examiner

TEMPORARY CORROSION PROTECTION LAYER

BACKGROUND

The present disclosure relates to a method for producing a component made of a steel product coated with an Al—Si protective coating.

Nowadays, steel products such as steel strips or steel sheets are provided with an Al—Si protective coating by means of hot-dip aluminizing to protect against corrosive influences.

So that local spalling of the protective coating does not occur as a part of the shaping process to form a desired component, the steel products are normally alloyed with the iron of the base material. This requires longer annealing times.

It is known from DE 10 2008 006 771 B3 that a pre-alloyed Al—Si protective coating produces a reduced heating duration as compared to an Al—Si protective coating that is not pretreated.

Despite the existing protective coating in the case of steel products that are pre-alloyed in this manner, practice has shown, however, that corrosion (red rust) forms on the surface caused by the weather, for example during storage and/or transport.

BRIEF DESCRIPTION

Therefore, the problem addressed by the present disclosure is providing a method that overcomes the disadvantages of the prior art.

According to one aspect, the method for producing a component made of a steel product coated with an Al—Si protective coating includes the following steps:

- providing a substrate consisting of a steel product coated with an Al—Si protective coating,
- heating the substrate to a temperature $T_1$ such that the Al—Si protective coating is only partially pre-alloyed with Fe of the steel product,
- cooling the pre-alloyed substrate to room temperature,
- applying a corrosion protection oil to the surface of the pre-alloyed substrate, wherein the corrosion protection oil consists of a composition containing fatty acid esters,
- transporting the pre-alloyed substrate to which the corrosion protection oil has been applied,
- heating the pre-alloyed substrate to which the corrosion protection oil has been applied to a temperature $T_2$ such that the Al—Si protective coating is fully alloyed with Fe of the steel product and the corrosion protection oil is removed without leaving residue, and
- shaping the re-heated substrate to form the component.

It was surprisingly shown that—along with the additional temporary corrosion protection—the pre-alloyed substrate to which the corrosion protection oil has been applied does not leave any residues after re-heating for the shaping process that have a disadvantageous effect on material performance and thus do not negatively impact other process steps within the production chain.

In addition, it was surprisingly shown that the heating of the pre-alloyed substrate to which the corrosion protection oil has been applied to the temperature $T_2$ could be shortened significantly.

In the case of the method according to one aspect, first a substrate consisting of a steel product coated with an Al—Si protective coating is provided. The steel product in the present case is a steel sheet or steel strip, which is coated with an Al—Si protective coating. Typically the steel product is coated by means of hot-dip aluminizing.

In a further process step, the substrate is heated to a temperature $T_1$ such that the Al—Si protective coating is only partially pre-alloyed with Fe of the steel product. The substrate that is not fully alloyed in this manner has a ductility, which allows the substrate obtained to be divided or cut without damaging the protective coating.

The heating of the substrate to the temperature $T_1$ can be carried out in this case in a batch-type annealing furnace, chamber furnace or in a continuous annealing furnace.

These types of Al—Si protective coatings that are not fully alloyed preferably have a Fe content of 25-50% by weight. In an especially preferred variant, the Al—Si protective coating consists of 10% by weight Si, 25-50% by weight Fe and the remainder Al.

After cooling of the pre-alloyed substrate to room temperature, according to one aspect, a corrosion protection oil is applied to the surface, wherein the corrosion protection oil consists of a composition containing the fatty acid esters. The application of the corrosion protection oil to the pre-alloyed substrate can take place for example by spraying or immersing in a bath containing the corrosion protection oil. Alternatively, the application of the corrosion protection oil takes place by means of a roller application process.

Alternatively, before cooling to room temperature, the pre-alloyed substrate can be immersed in a bath containing the corrosion protection oil in order to cool it in one process step and provide it with the temporary corrosion protection.

Then the pre-alloyed substrate to which the corrosion protection oil has been applied is transported. The term transport used here includes all types of transport processes where the pre-alloyed substrate is moved from a first location, for example a steel producer, to a second location, for example a production plant of a steel processing company or a storage facility.

In a further step of the method according to one aspect, the pre-alloyed substrate to which the corrosion protection oil has been applied is heated to a temperature $T_2$ such that the Al—Si protective coating is fully alloyed with Fe of the steel product and the corrosion protection oil is removed without leaving residue. As a result, neither cracked carbon chains remain on the surface nor do any corrosive or toxic combustion residues develop during the heating process.

The heating of the substrate to the temperature $T_2$ can be carried out inductively, conductively or by means of thermal radiation in a continuous furnace.

Then the re-heated substrate is shaped to form the desired component.

It can be preferred that it is a hot forming here. Furthermore, it can be preferred that the component is automobile bodies or parts thereof.

According to an exemplary embodiment, the temperature $T_2$ corresponds to a temperature range of 850° C. to 1000° C. More preferably the temperature $T_2$ corresponds to 880° C. to 930° C.

According to another exemplary embodiment, the heating of the pre-alloyed substrate to which the corrosion protection oil has been applied to the temperature $T_2$ comprises the following process steps:

- heating the substrate to the temperature range $T_2$ of 850° C. to 1000° C., preferably 880° C. to 930° C.,
- holding the substrate in the temperature range $T_2$, and
- cooling the substrate to a temperature range $T_3$ of 550° C. to 780° C., preferably 600° C. to 700° C.

The heating to $T_2$ is preferably 60 to 210 s, preferably 90 to 180 s. The heating of the substrate in this case is dependent on the thickness of the substrate and must be adjusted individually in relation to the respective substrate used.

It is preferred that the holding in the temperature range $T_2$ is 60 to 600 s, preferably 30 to 120 s.

The cooling takes place preferably with a cooling rate in the range of 5 to 25 K/s, preferably in the range 10 to 20 K/s.

Furthermore, the cooling of the substrate preferably takes place during the transfer of the substrate to a mold, where the substrate undergoes a shaping process.

A further cooling then takes place during the shaping process in order to then cure with full positive engagement with the mold.

The heating to $T_2$ preferably takes place under a protective atmosphere. Dry air or a protective gas, such as a nitrogen gas for example, can be used as a protective atmosphere.

In another exemplary embodiment, the temperature $T_1$ corresponds to a temperature range of 550° to 750° C., preferably of 550° to 700° C.

In another exemplary embodiment, the composition contains at least 98% by weight, preferably 98.5-99% by weight of the fatty acid esters. In the case of this type of composition, the gaseous combustion residues are made up of $CO_2$ and $H_2O$ and can be discharged from the furnace chamber along with the exhaust air without further expensive measures.

In yet another exemplary embodiment, the fatty acid esters is a $C_8$-$C_{16}$ compound, more preferably a $C_{11}$-$C_{17}$ compound.

The composition preferably has a sulfur content in the range of 1-2% by weight, more preferably in the range of 1-1.5% by weight.

The composition preferably has a saponification number in the range of 150-265 mg KOH/g, more preferably in the range of 165-195 mg KOH/g.

In still another exemplary embodiment, the corrosion protection oil is applied to the substrate in a quantity 0.5 to 2 g/m$^2$, more preferably 0.7-1.7 g/m$^2$.

The composition of the corrosion protection oil preferably does not contain any fats.

The composition especially preferably does not contain any additives or inhibitors.

According to a further exemplary embodiment, the corrosion protection oil is not removed from the substrate to which the corrosion protection oil has been applied by means of a cleaning step before it is heated to the temperature $T_2$. As a result, it is possible to dispense with, among other things, a complex cleaning device within the process. Furthermore, the entire process becomes not only more cost effective, because the process times are shorter as compared to methods with a cleaning step, but also more environmentally friendly.

According to a further aspect, the present disclosure relates to the use of a corrosion protection oil consisting of a composition containing fatty acid esters as temporary corrosion protection for the storage and/or transport of pre-alloyed substrates consisting of a steel product coated with an Al—Si protective coating.

EXAMPLES

The present disclosure will be explained in greater detail in the following based on examples.

A substrate consisting of a steel sheet with a sheet thickness of 1.5 mm with quality 22MnB5 was provided with a 25 μm thick Al—Si protective coating in a hot-dip process. The protective coating contained 10% by weight Si, 3% by weight Fe and the remainder Al. The steel product coated with the Al—Si protective coating was pre-alloyed as a pre-assembled plate at 700° C. in a circulating air furnace. The Al—Si protective coating of the steel sheet that was pre-alloyed in this manner now contained 30% by weight Fe, 10% by weight Si and the remainder Al. Then 0.5 g/m$^2$ of a corrosion protection oil was applied in a roller application process. The corrosion protection oil used in this case was a fatty acid derivative of a native oil, which does not contain any further additives or inhibitors. After transport and storage, these sheets were further processed at a site that is not protected from the weather. Prior to further processing, no changes to the surface or corrosion damage could be detected. The sheets were conveyed by means of industrial robots to a hot forming furnace for further processing and austenitized at 925° C. in 2.5 min enough that they could then be shaped and cured in a cooled mold. Measurements at the hot forming furnace showed no further emissions in the furnace atmosphere other than $CO_2$, $H_2O$ and the furnace atmosphere that already existed beforehand in the form of nitrogen. No residues of the applied oil could be detected even on the press hardened component.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. Method for producing a component made of a steel product coated with an Al—Si protective coating, comprising:

providing a substrate consisting of a steel product coated with an Al—Si protective coating, heating the substrate to a temperature T1 such that the Al—Si protective coating is only partially pre-alloyed with Fe of the steel product, cooling the pre-alloyed substrate to room temperature, applying a corrosion protection oil to the surface of the pre-alloyed substrate, wherein the corrosion protection oil contains fatty acid esters, transporting the pre-alloyed substrate to which the corrosion protection oil has been applied, heating the pre-alloyed substrate to which the corrosion protection oil has been applied to a temperature T2, wherein the corrosion protection oil is not removed from the substrate by cleaning the pre-alloyed substrate to which the corrosion protection oil has been applied before it is heated to T2 and the heating is carried out to T2 such that the Al—Si protective coating is fully alloyed with Fe of the steel product and the corrosion protection oil is removed without leaving residue, and shaping the re-heated substrate to form the component.

2. Method according to claim 1, wherein the heating to T2 takes place under a protective atmosphere.

3. Method according to claim 1, wherein the composition contains at least 98% by weight of the fatty acid esters.

4. Method according to claim 1, wherein the fatty acid esters is a C8-C16 compound.

5. Method according to claim 1, wherein the composition has a sulfur content in the range of 0.1-2% by weight.

6. Method according to claim 1, wherein the composition has a saponification number in the range of 150-265 mg KOH/g.

7. Method according to one of the preceding claim 1, wherein the corrosion protection oil is applied to the substrate in a quantity of 0.5 to 2 g/m2.

8. Method according to claim 1, wherein the temperature T2 corresponds to a temperature range of 850° C. to 1000° C.

9. Method according to claim 1, wherein the temperature T1 corresponds to a temperature range of 550° to 780° C.

10. Method according to claim 1, wherein the heating of the pre-alloyed substrate to which the corrosion protection oil has been applied to the temperature T2 comprises:

heating the substrate to the temperature range T2 of 850° C. to 1000° C., holding the substrate in the temperature range T2, and cooling the substrate to a temperature range T3 of 550° C. to 750° C.

11. Method according to claim 8, wherein the temperature T2 corresponds to a temperature range of 880° C. to 930° C.

12. Method according to 8, wherein the temperature T1 corresponds to a temperature range of 600° to 700° C.

13. Method according to claim 10, wherein the temperature T2 is a temperature range of 880° C. to 930° C. and/or the temperature range T3 is a temperature range of 600° C. to 700° C.

14. Method according to claim 10, wherein the heating to T2 is 60 to 210 s.

15. Method according to claim 10, wherein the holding in the temperature range T2 is 30 to 600 s.

16. Method according to claim 10, wherein the cooling after the pre-alloying takes place occurs with a cooling rate in the range of 2 to 25 K/s.

17. Method according to claim 14, wherein the heating to T2 is 90 to 180 s.

18. Method according to claim 15, wherein the holding in the temperature range T2 is 30 to 120 s.

19. Method according to claim 16, wherein the cooling after the pre-alloying takes place occurs with a cooling rate in the range of 8 to 20 K/s.

* * * * *